US006715521B2

(12) United States Patent
Back

(10) Patent No.: US 6,715,521 B2
(45) Date of Patent: Apr. 6, 2004

(54) TOOTHPASTE DISPENSING UNIT

(75) Inventor: Terrence Norman Back, Thornhill (CA)

(73) Assignee: Josephine Sue Ching Back, Thornhill (CA)

( * ) Notice: Subject to any disclaimer, the term of this patent is extended or adjusted under 35 U.S.C. 154(b) by 0 days.

(21) Appl. No.: 10/028,352

(22) Filed: Dec. 21, 2001

(65) Prior Publication Data

US 2003/0116586 A1 Jun. 26, 2003

(51) Int. Cl.[7] ..... B67D 5/52

(52) U.S. Cl. ..... 141/362; 222/95; 222/326; 222/386

(58) Field of Search ..... 222/95, 325, 326, 222/386; 141/362

(56) References Cited

U.S. PATENT DOCUMENTS 4,303,110 A * 12/1981 Chen ..... 141/362
4,600,126 A * 7/1986 Arango ..... 222/95
4,684,044 A * 8/1987 Foster ..... 2222/386

* cited by examiner

*Primary Examiner*—Philippe Derakshani
(74) *Attorney, Agent, or Firm*—Powell, Goldstein, Frazer & Murphy LLP; Jason A. Bernstein

(57) ABSTRACT

A housing for toothpaste dispensing containers able to accommodate various pumps, squeeze-type tubes and replaceable cartridges. The housing allows for toothpaste to be cleanly, accurately and easily deposited onto a toothbrush with the use of one hand. Holders are attachable to the housing to give contamination-free storage of toothbrushes and the unit can be affixed to a vertical surface or remain free-standing on a wash basin counter.

10 Claims, 17 Drawing Sheets

FIG. 12
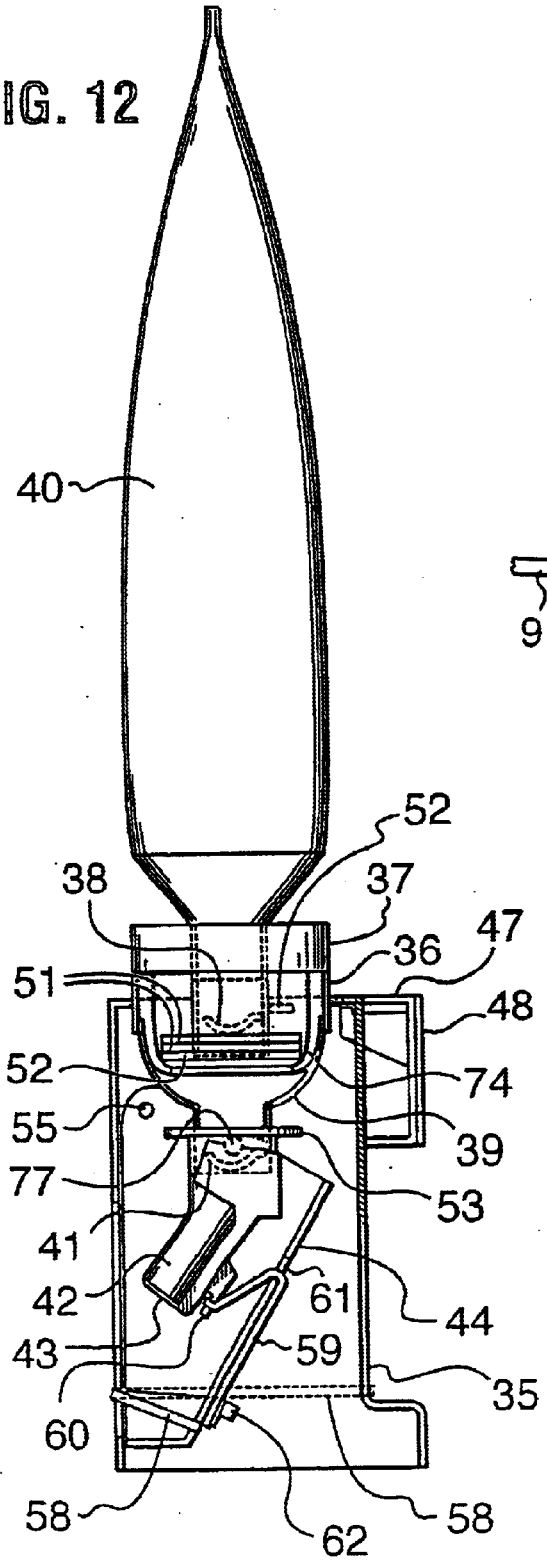
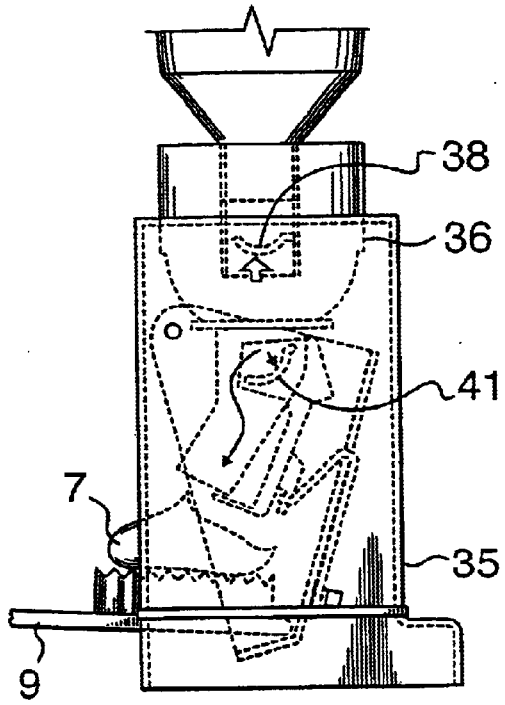
FIG. 12a
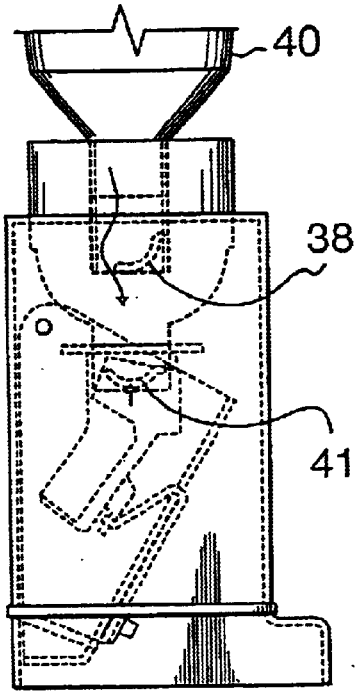
FIG. 12b

TOOTHPASTE DISPENSING UNIT

FIELD OF THE INVENTION

This invention relates to a toothpaste dispensing unit, more particularly a unit for use with squeeze-type tubes, pumps and replaceable cartridges of tooth paste, that is operable with one hand.

BACKGROUND TO THE INVENTION

All known manually-operated toothpaste pumps and tubes require the use of two hands and a certain degree of care and control to operate. This can be challenging for the elderly, the young and some handicapped persons, resulting in a messy counter top and dispenser. Toothpaste tubes are often left with the caps off, causing a hardening of the contents in and around the nozzle of the tube. When a pump is used as a dispensing means, toothpaste hardens around the spout and valve and often falls onto pump parts, rather than onto the toothbrush. Furthermore, most pumps consist of a one-piece moulding of the pump to the toothpaste container, which is not cost-effective, as the entire unit must be discarded each time the toothpaste is exhausted.

Storage space can also be a problem, as it is often limited in small bathrooms, particularly when they are shared by many people. Toothpaste and toothbrushes are often stored together in beakers or on racks, which causes clutter and exposes the brushes to cross-contamination.

SUMMARY OF THE INVENTION

It is therefore a feature of the present invention to provide a means whereby various pumps can be incorporated into a system that allows toothpaste to be dispensed with greater ease, accuracy and cleanliness using only one hand. Another feature of the invention is to provide a more cost-effective pump that can be used with squeeze-type tubes. It is a further feature of the invention to provide a replaceable cartridge that can be used with the more cost-effective pump. A further feature of the invention is to conserve space by providing a clean, tidy and self-contained toothpaste and toothbrush storage system that protects toothbrushes from cross-contamination.

With regard to the first feature, a pump housing that immobilises a pump unit in an inverted, vertical position is provided. Modified versions of the housing are available to accommodate the pumps that are currently available on the market, under the brand names of AQUAFRESH™, COLGATE™, and HENKEL™. The means of immobilisation ranges from a means to engage a peripheral recess in the pump body, to a means to engage a screw thread on the body of the pump, thereby securing the pump within the housing. Also incorporated into the housing is a swing trigger which, when pressed upon with a toothbrush, with the use of just one hand, activates a trigger on the pump, thereby opening the pump outlet valve and allowing the toothpaste to be dispensed. The swing trigger also acts to guide the toothbrush so as to ensure accuracy and ease of use. As with the means of immobilisation, the swing trigger is also modified for adaptation to the various types of pumps.

The important feature of providing a more cost-effective pump is achieved in a preferred embodiment by making available a reusable and easily cleaned take-apart pump to be used within the housing. The pump is composed of a trigger, a pliable displacement chamber, a back float valve and a front flap valve. When the pump trigger is depressed by the swing trigger, the flexible displacement chamber distorts, reducing the volume within the chamber, and causing the float valve to shut in order to prevent toothpaste from regressing back into the attached container. At the same time, the front flap valve opens to allow toothpaste to be expelled through the spout.

The swing trigger for use with the take-apart pump may be equipped with resilient members such as elastic bands to assist in properly guiding the swing when it is pushed on by a toothbrush toward the rear of the housing to compress the trigger on the pump. One of the bands also aids in raising and lowering a shield on the spout of the pump to control the flow of toothpaste. When the toothpaste has been dispensed, and the toothbrush is withdrawn, the elastics compress to return the swing trigger back into its original position and close the spout shield so that toothpaste cannot leave the spout when the dispenser is not in use.

A connecting attachment is provided to the take-apart pump so that it can be used, within the housing, in conjunction with most known squeeze-type toothpaste containers. The bottom surface of the attachment contains engaging threads, allowing it to be screwed into the pump, while the upper surface is equipped internally, with a threaded, small-diameter hole which can accept the nozzle of a toothpaste tube.

Regarding the feature of providing a replaceable cartridge for use with the housing and the inverted pump, a pack consisting of a rigid, tubelike cartridge is attached to the pump by the mating together of threads. This replaceable pack utilizes atmospheric pressure, so that when the displacement chamber is empty, and the pressure is reduced, the back flap valve will open, causing toothpaste to flow rout of the pack and into the chamber. A follower piston moves down incrementally as the atmospheric pressure becomes greater than the pressure inside the container.

Lastly, the feature of hygienic toothbrush storage is achieved in a preferred embodiment by the attachment of two tumblers, or prongs, into slots located on opposing sides of the housing. Each tumbler requires little space and accepts only one toothbrush for storage, yet can still hold sufficient water for efficient mouth rinsing. The prongs, which are also releasably attached to the housing, require even less space, while still allowing for adequate, contamination-free storage of toothbrushes when the unit is affixed to a wall.

BRIEF DESCRIPTION OF THE DRAWINGS

Preferred embodiments of the present invention will now be described in greater detail, and will be better understood when read in conjunction with the following drawings, in which:

FIG. 12 is a sectional view of the housing, with the inverted take-apart pump inside, in use with a squeeze-type tube of toothpaste;

FIG. 12*a* is a sectional view, showing the positions of the valves within the pump, while toothpaste is being dispensed from the tube;.

FIG. 12*b* is a sectional view, the positions of the valves after toothpaste has been dispensed, and replacement occurs;

DETAILED DESCRIPTION OF THE DRAWINGS

Figure 1:
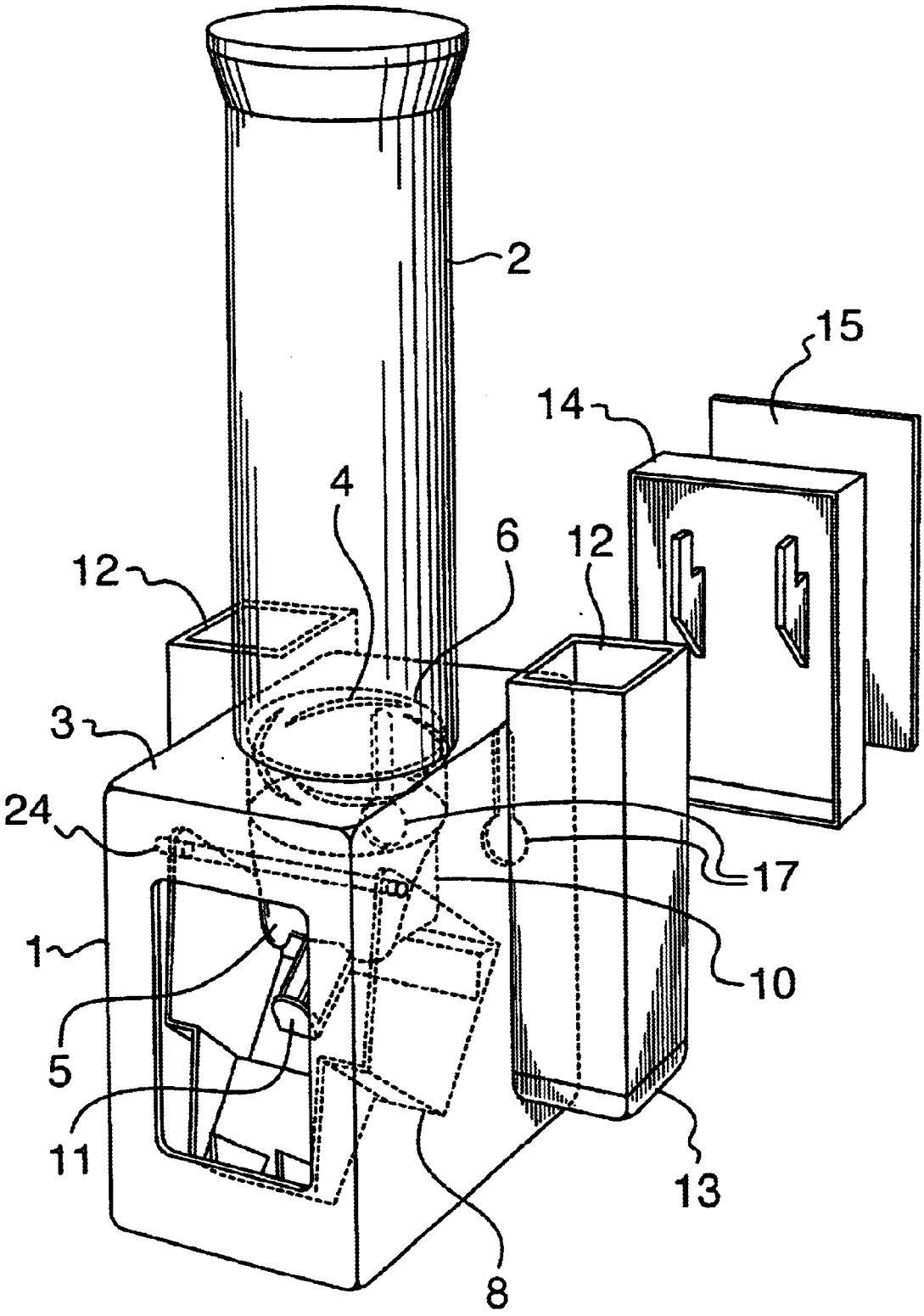
FIG. 1 is a perspective view of a variation of the housing in use with a commercially available pump with accessories including: toothbrush storage, rinsing tumblers, wall bracket and two-side adhesive tape.
Figure 2:
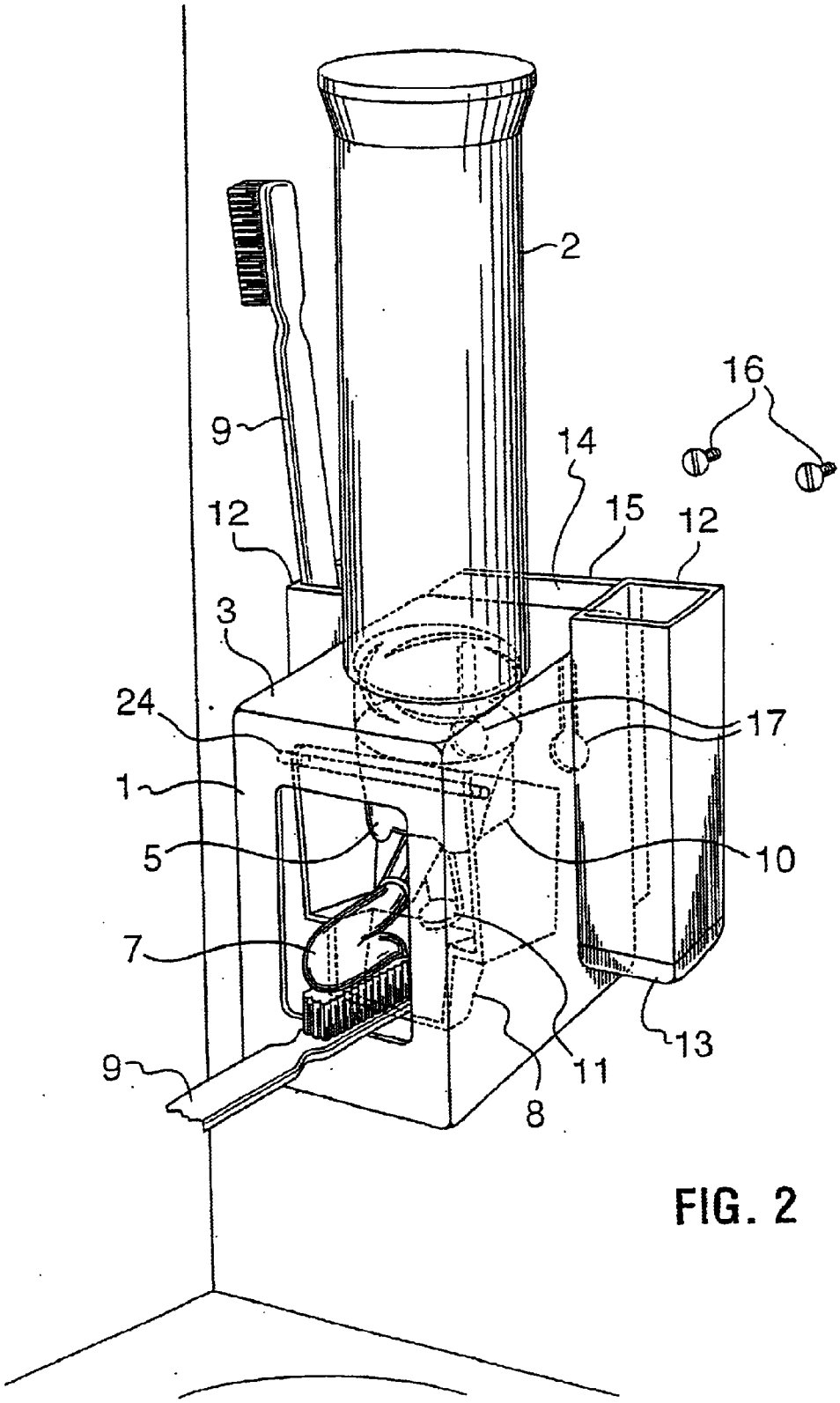
FIG. 2 is a perspective view of the housing of FIG. 1, with accessories, as shown in FIG. 1, with toothpaste being dispensed.
Figure 3:
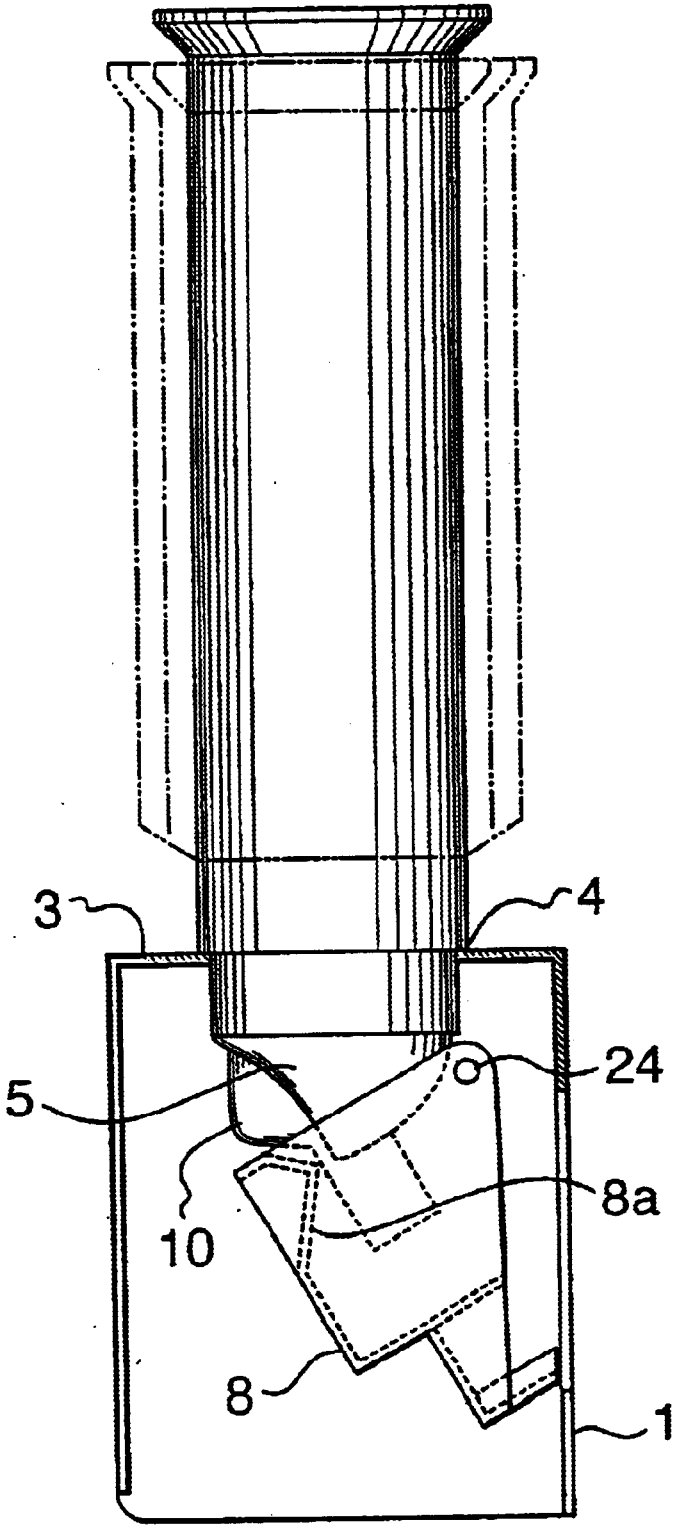
FIG. 3 is a sectional view of the housing in use with varying sizes of a pump.

FIGS. 1–3 show a pump housing unit 1 for dispensing a viscous substance such as toothpaste, adapted for use with a pump 2. Pump 2 is disclosed in U.S. Pat. No. 4,684,044 assigned to Realex Corporation and is used on dispensers for AQUAFRESH™brand of toothpaste sold by Smith, Kline, Beecham. A further detailed description of the pump will therefore be omitted. The housing 1 includes an upper surface 3, having threaded annular hole 4, which allows passage of the inverted pump 5, while supporting the shoulder 6 of pump 5. Threaded hole 4 mates with the moulded threads on the pump 2 to hold the pump upside down and immobile within the housing 1, during the discharge of the toothpaste 7.

Pump housing 1 is also provided with a pump actuating lever such as a swing trigger 8 to guidingly receive a toothbrush 9. When a toothbrush 9 is pushed against swing trigger 8, it pivots rearwardly about pin 24 to depress a trigger 14 on pump 10, which simultaneously opens outlet valve 11 and extrudes toothpaste onto the toothbrush.

Advantageously, each side of pump housing 1 is equipped with a toothbrush holder 12, with a removable base 13 for easy cleaning. The holders 12, which can also act as rinsing tumblers, house a toothbrush 9 in a manner to prevent cross-contamination from other brushes.

A wall bracket 14 is removably attached to housing 1 so that it can be affixed to a wall using for example double-sided adhesive tape 15. Screws 16 which fit into slots 17 in the rear of housing 1 are provided as an alternate means of attachment, or if attaching the unit to a wall is not desirable, the housing can be used free-standing on the washbasin counter top.

FIG. 1 shows the AQUAFRESH pump 2 secured in a stationary position within housing 1, while FIG. 2 shows housing unit 1 with pump 2, after the completion of a dispensing stroke. FIG. 3 shows housing 1 in use with the various sizes of AQUAFRESH pumps that are currently available on the market. This figure best illustrates a shoulder 8*a* on swing trigger 8 that pushes against pump trigger 14 when a toothbrush is used to push against the swing trigger itself.

Figure 4:
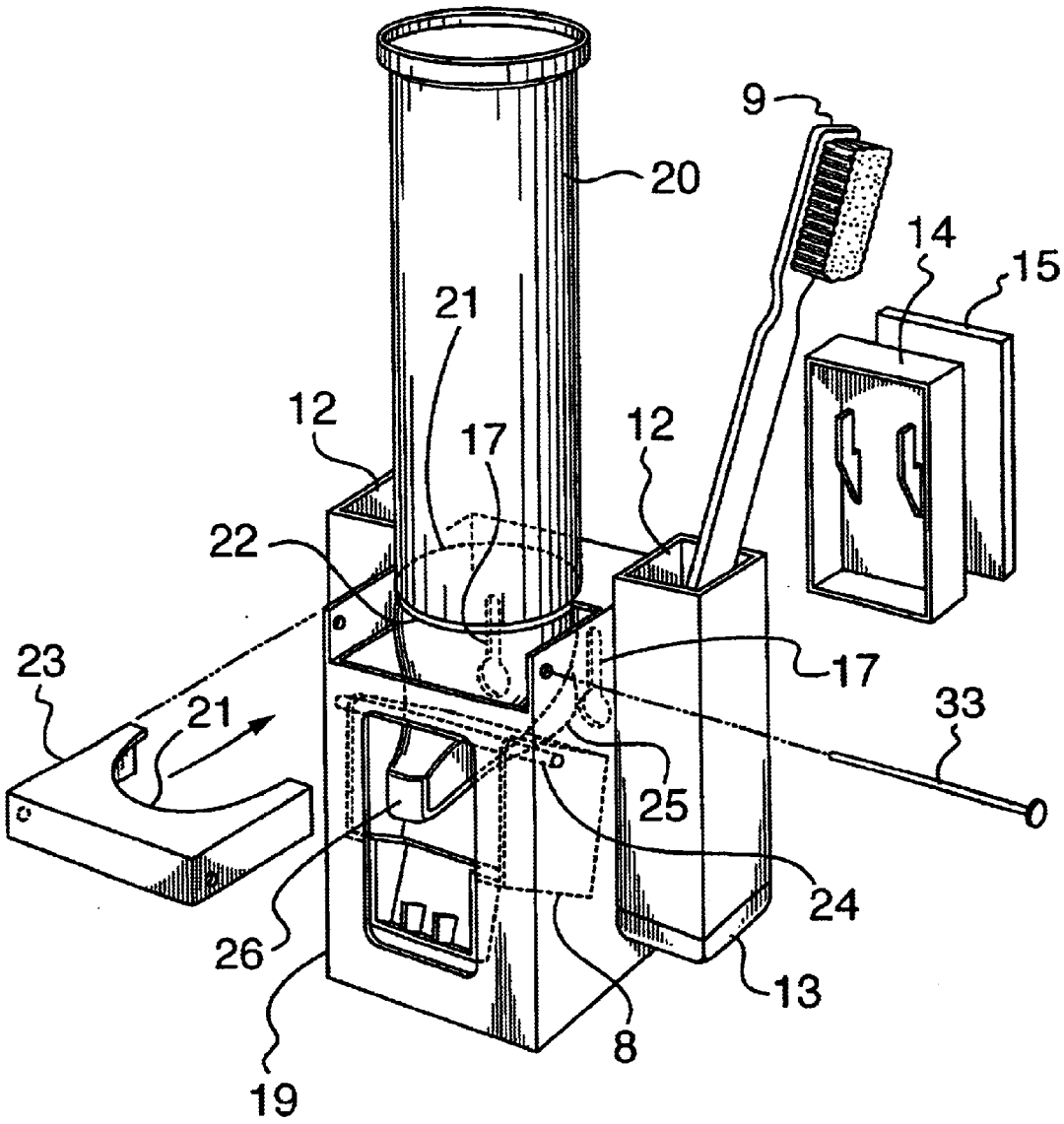
FIG. 4 is a perspective view of a variation of the housing in use with a modified pump, with accessories as above.
Figure 5:
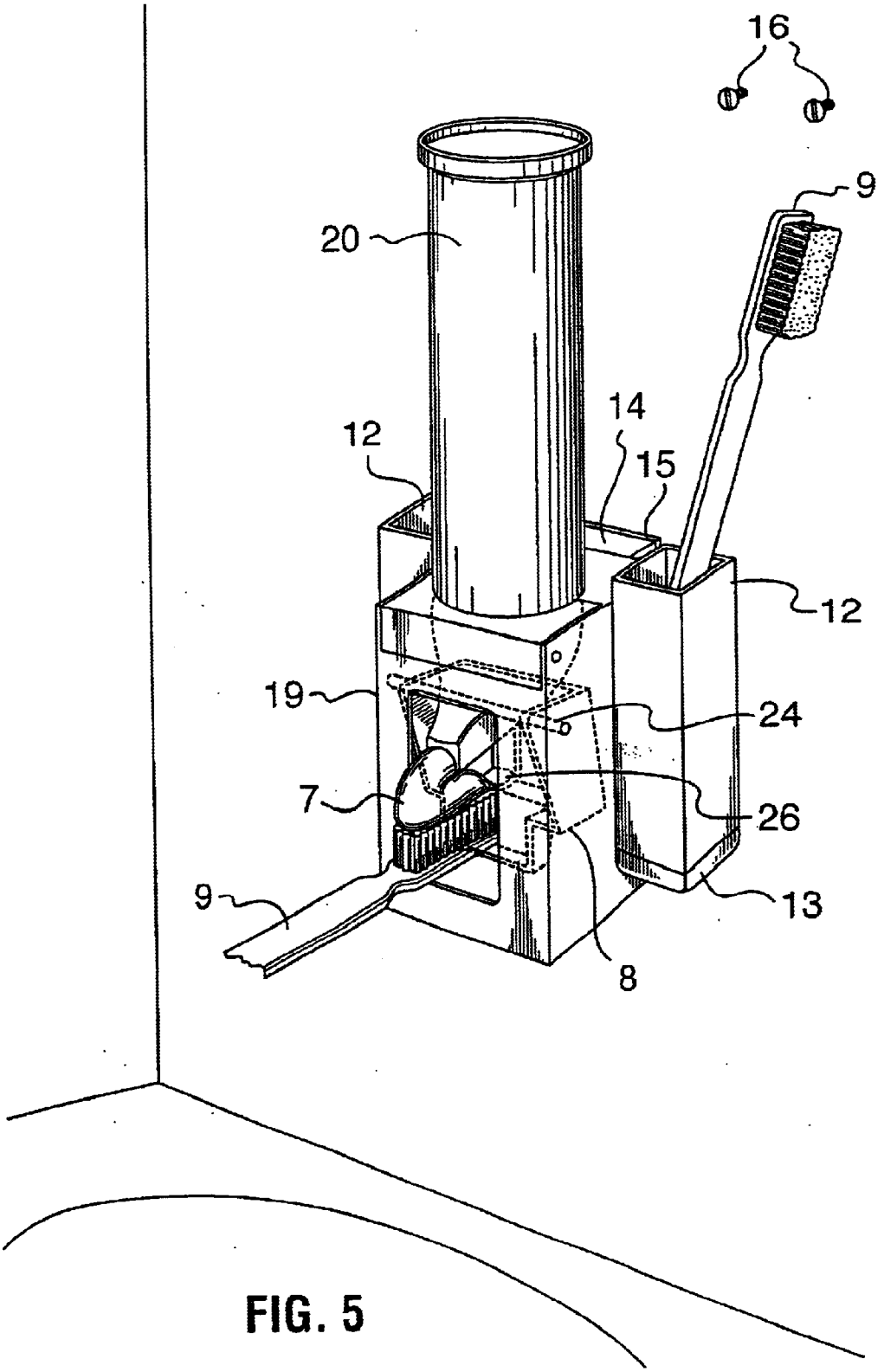
FIG. 5 is a perspective view of a variation of the housing with accessories, as shown in FIG. 4, with toothpaste being dispensed.
Figure 6:
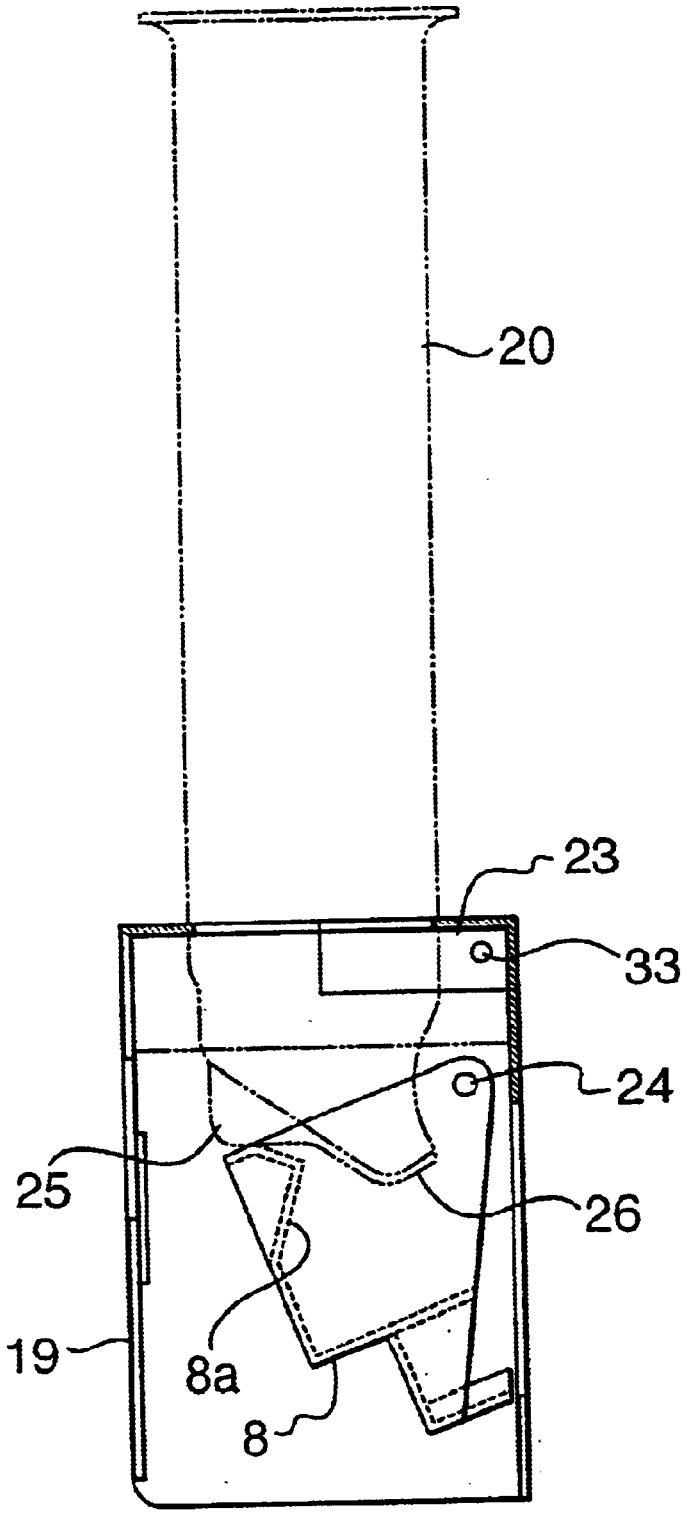
FIG.6 is a sectional view of a variation of the housing in use with the pump shown in FIG. 4.

FIGS. 4–6 show a pump housing 19, adapted to fit a pump type dispenser 20 used for COLGATE™brand toothpaste. Pump 20 lacks moulded threads to mate with threads formed into the housing. Another means of attachment of the pump to the housing is therefor required. One solution is shown in FIG. 4 wherein a split collar 23 having a semi-circular recess 21, formed therein is removably connected to the housing such as by means of a pin 44. The housing's upper surface has a correspondingly sized and shaped opposingly oriented semi-circular recess 21 therein. The periphery of recess 21 is sized to fit into a peripheral recess 22 formed in the pump body as manufactured to securely connect the pump to the housing when pin 44 is inserted.

FIGS. 4 and 6 show pump 20 secured in a stationary position within the housing 19, while FIG. 5 shows the housing 19 with the pump 20 in use, and at the end of a dispensing stroke. At the end of the dispensing stroke shown in FIG. 5, swing trigger 8 by virtue of having been pushed inwardly by a toothbrush 9, is shown positioned toward the rear of the housing 19, after it has depressed the pump trigger 25, to open the pump outlet valve 26 so that toothpaste 7 can be expelled from the pump spout onto the toothbrush 9. Also shown in FIGS. 4 and 5 are the rinsing tumblers 12, wall brackets 14 and screws 16 for affixing the unit to a wall.

Figure 7:
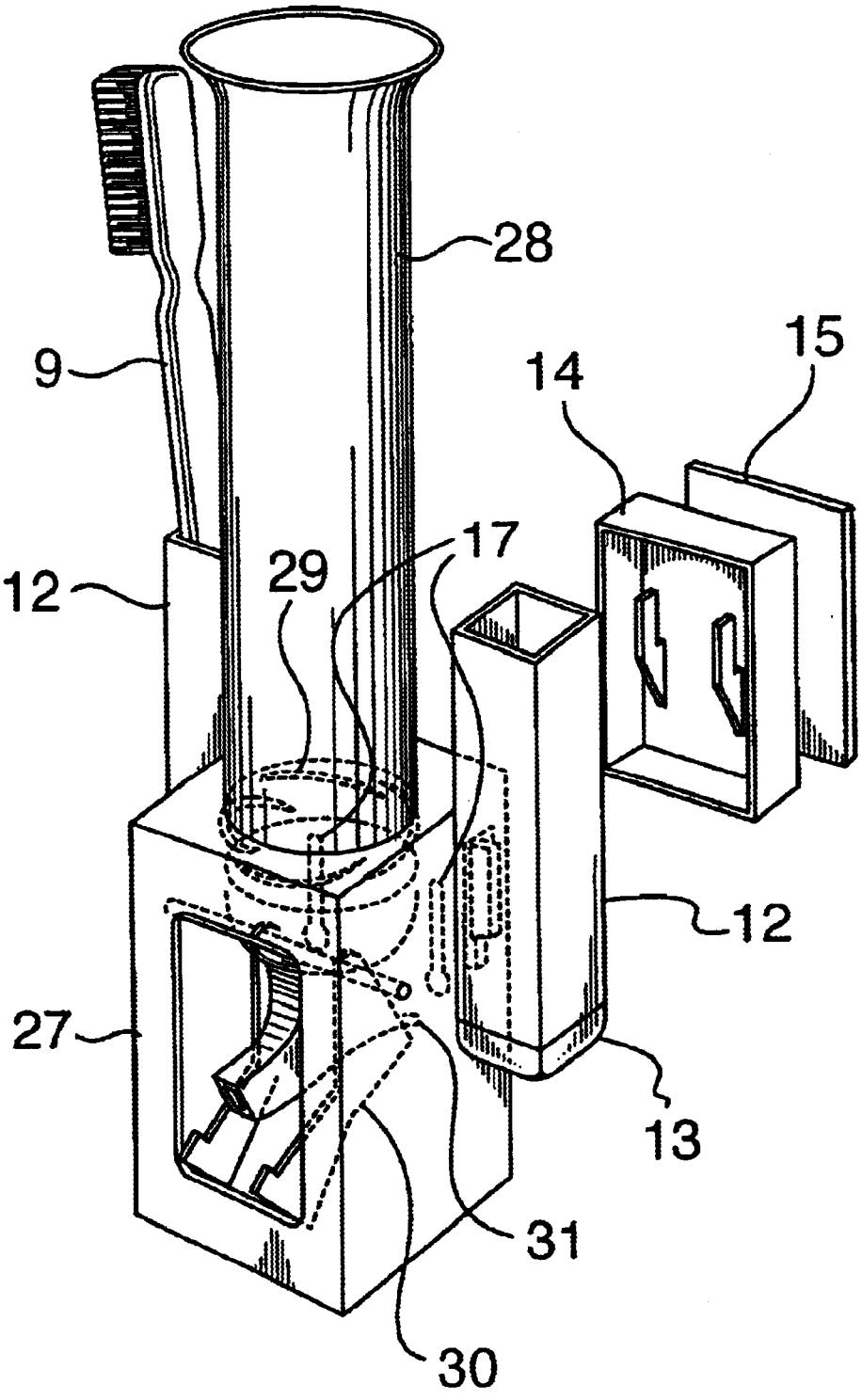
FIG. 7 is a perspective view of a variation of the housing in use with another type of pump, with accessories as above.
Figure 8:
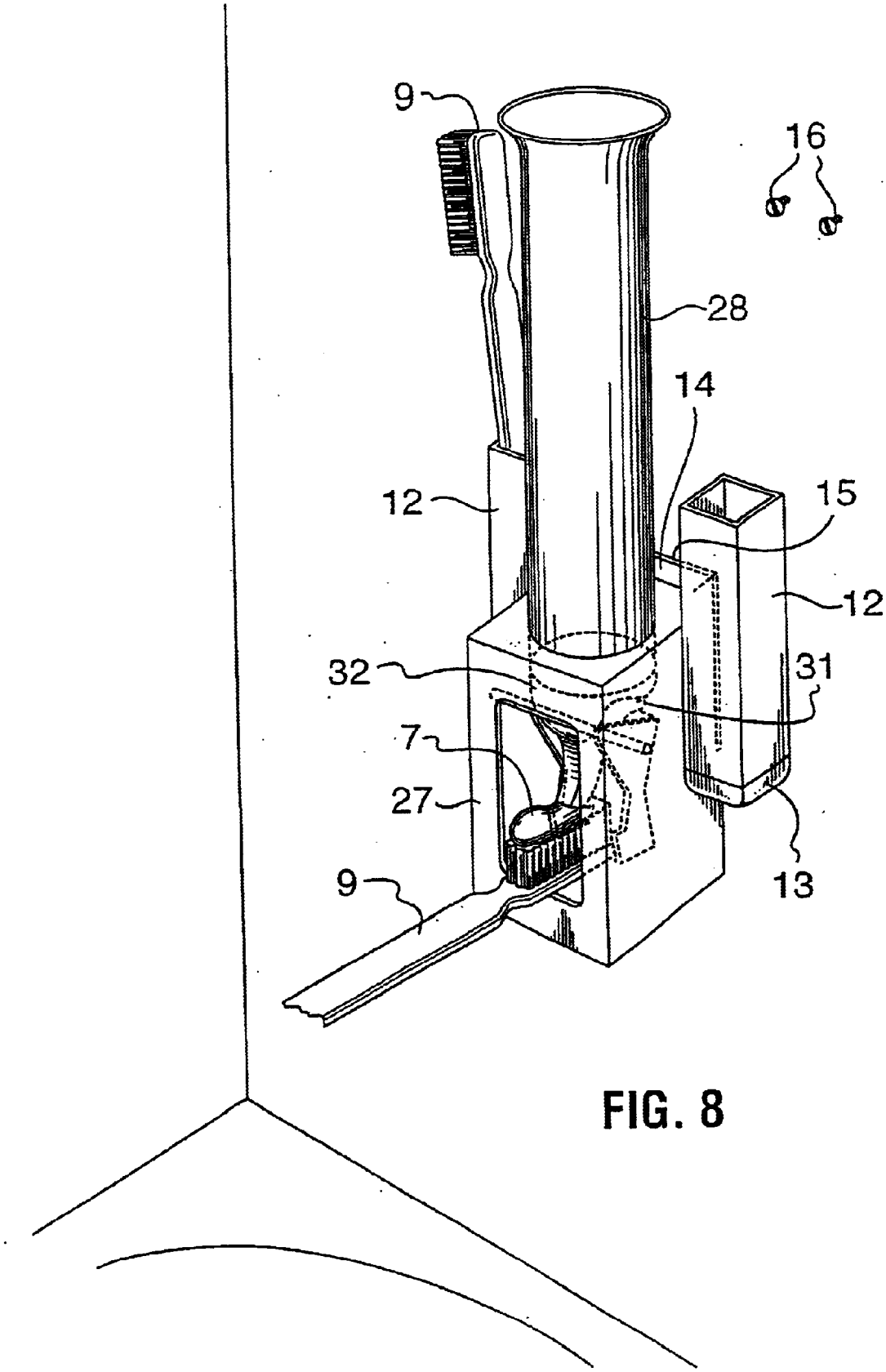
FIG. 8 is a perspective view of the housing variation, as shown in FIG. 7, with toothpaste being dispensed.
Figure 9A:
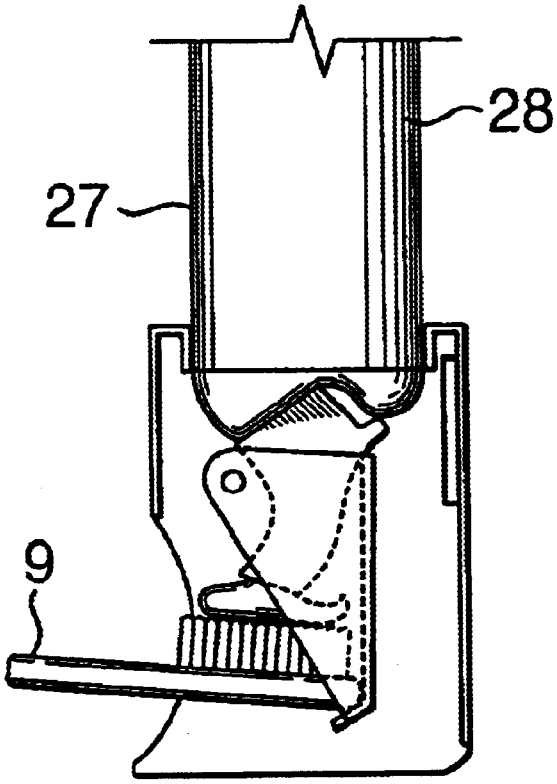
FIG. 9*a* is a sectional view of the housing variation, as shown in FIG. 9, with toothpaste being dispensed.
Figure 9:
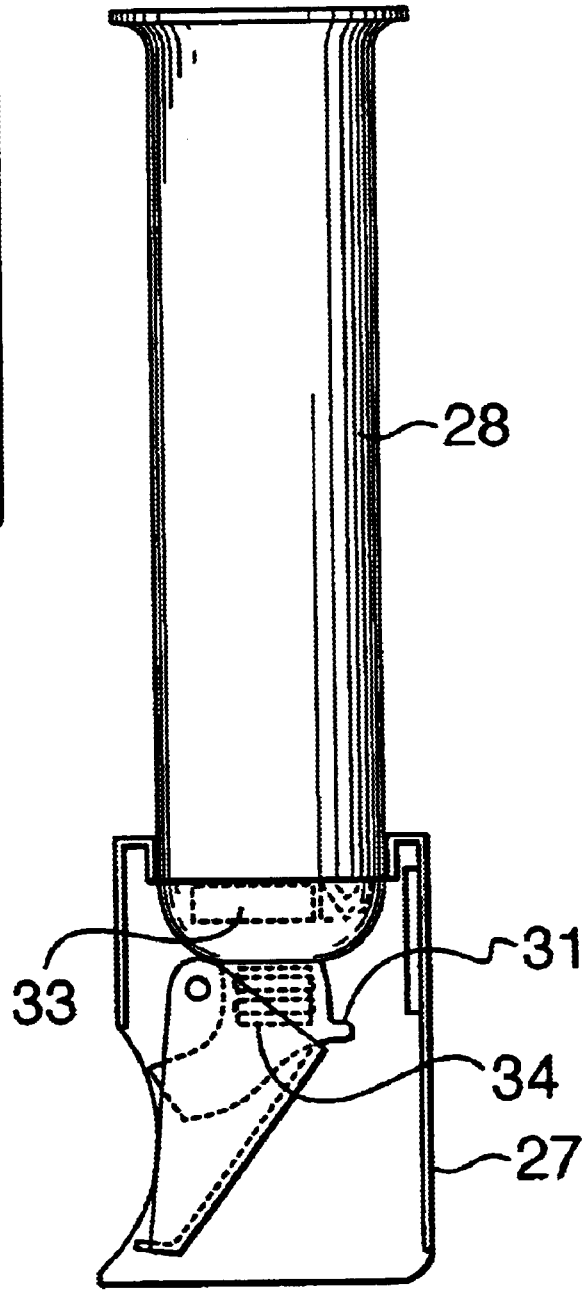
FIG. 9 is a sectional view of a variation of the housing in use with the pump of FIG. 7.

FIGS. 7–9*a* show a housing 27 adapted for use with a pump 28 of the type manufactured by Schwarzkopf & Henkel of Dusseldorf, Germany (hereinafter "Henkel"). In FIGS. 7 and 9 the pump 28 is shown immobilized and inverted within the housing 27 by a mating of the complimentary screw threads 29 on the housing 27 and pump unit 28. The housing 27 is provided with a swing trigger 30 which engages a trigger 31 on the pump, allowing toothpaste to be dispensed.

FIGS. 8 and 9*a* show the unit at the end of a dispensing stroke after the swing trigger 30 has depressed pump trigger 31 to compress the pliable displacement chamber 32 of the pump so that toothpaste is expelled from the pump spout 34 and onto a toothbrush 9.

FIGS. 10–12*b* show an inverted Henkel-type pump 36, secured within a housing 35 and in use with a common squeeze-type toothpaste tube 40.

Pump 36 has been modified for use in connection with the present dispenser, and the modifications will be described in greater detail below. Pump 36 utilizes the same principals of operation as the Henkel pump. These principals will be readily apparent to those persons skilled in the art by merely examining the pump. Briefly however, the pump utilizes a follower piston, activated towards the front of the container by atmospheric pressure, but which does not need means to preclude backward movement of the piston since the displacement chamber 32 is separated from it by a back pressure float valve. The depressing of the pump trigger causes the flexible displacement chamber to distort, reducing the volume within the chamber, causing the float valve to shut and stop regression of toothpaste back into the container, and making, the front flap valve open to allow the expelling of toothpaste through the spout. After this operation, the front flap valve closes, atmospheric pressure moves the follower piston down causing the float valve to open and allow replacement within the displacement chamber of the toothpaste just evacuated.

Figure 10:
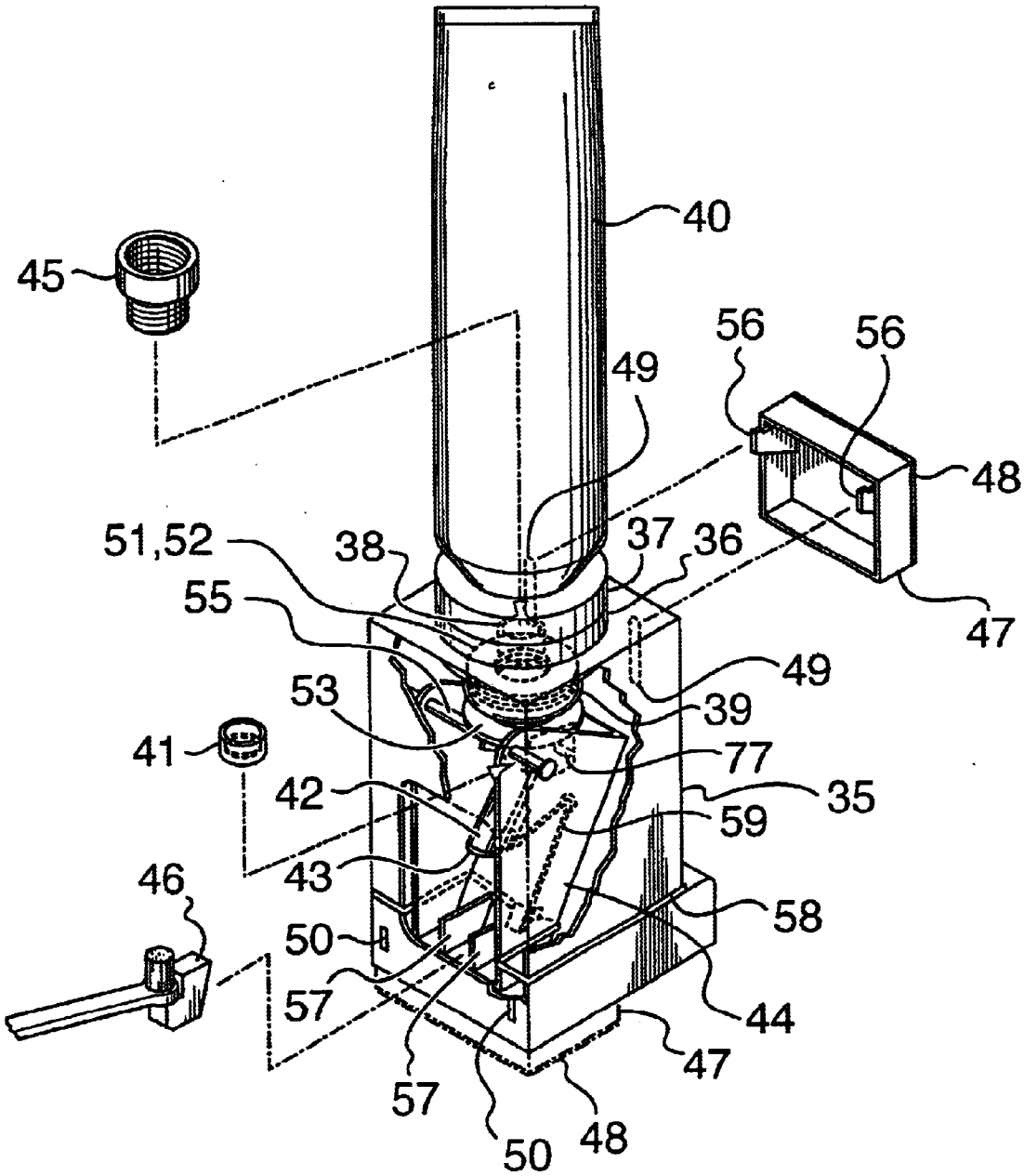
FIG. 10 is a perspective view of the housing, with an inverted take-apart pump secured inside, in use with a squeeze-type tube with accessories.

FIG. 10 illustrates how a squeeze-type toothpaste container 40 can be either screwed directly into a tube connector 37, or, if the engaging threads do not mesh, via a tube connector convertor 45 into which the threads can be pushed for a compressive friction fit, which will enable most squeeze-type toothpaste containers on the market to be used with the present device. Since most squeeze-type toothpaste tube containers are filled at speed, much air is included in the tube, and the mass of toothpaste contained in the tube, so instructions will be included on how to evacuate that air from within the tube before connecting the tube with the dispenser.

Once the air is evacuated from the tube 40, the empty part of the tube,40 is flattened and folded over and pressure kept on the filled part of the tube 40 so that toothpaste remains flush with the tube nozzle opening whilst the tube 40 is being screwed into the tube connector 37. When the tube 40 is connected to pump 36, it is necessary to prime the pump by keeping the flattened empty part of the tube 40 folded over, and applying pressure on the filled part of the tube 40 until toothpaste is seen to arrive at the end of the see-through spout 42. The system is now ready to dispense toothpaste.

Illustrated also in FIG. 10 is the housing holding bracket 47 with adhesive tape 48, which can either be affixed to a vertical surface, engaging the projecting supports 56 in the slots 49 in the rear of the housing 35, or fixed on a countertop surface engaging the projecting supports 56 in the slots 50 at the front of the housing 35.

If the dispenser is used with an electric toothbrush 9 in FIG. 10, an adapter 46 is wedged between spaced-apart toothbrush guides 57 on the swing trigger 44, thus allowing for pinpoint delivery of a small button of toothpaste onto the small circular bristle pad on most electric toothbrushes. Guides 57 are disposed on either side of swing trigger 44 for engaging the end of toothbrush 9.

Figure 11:
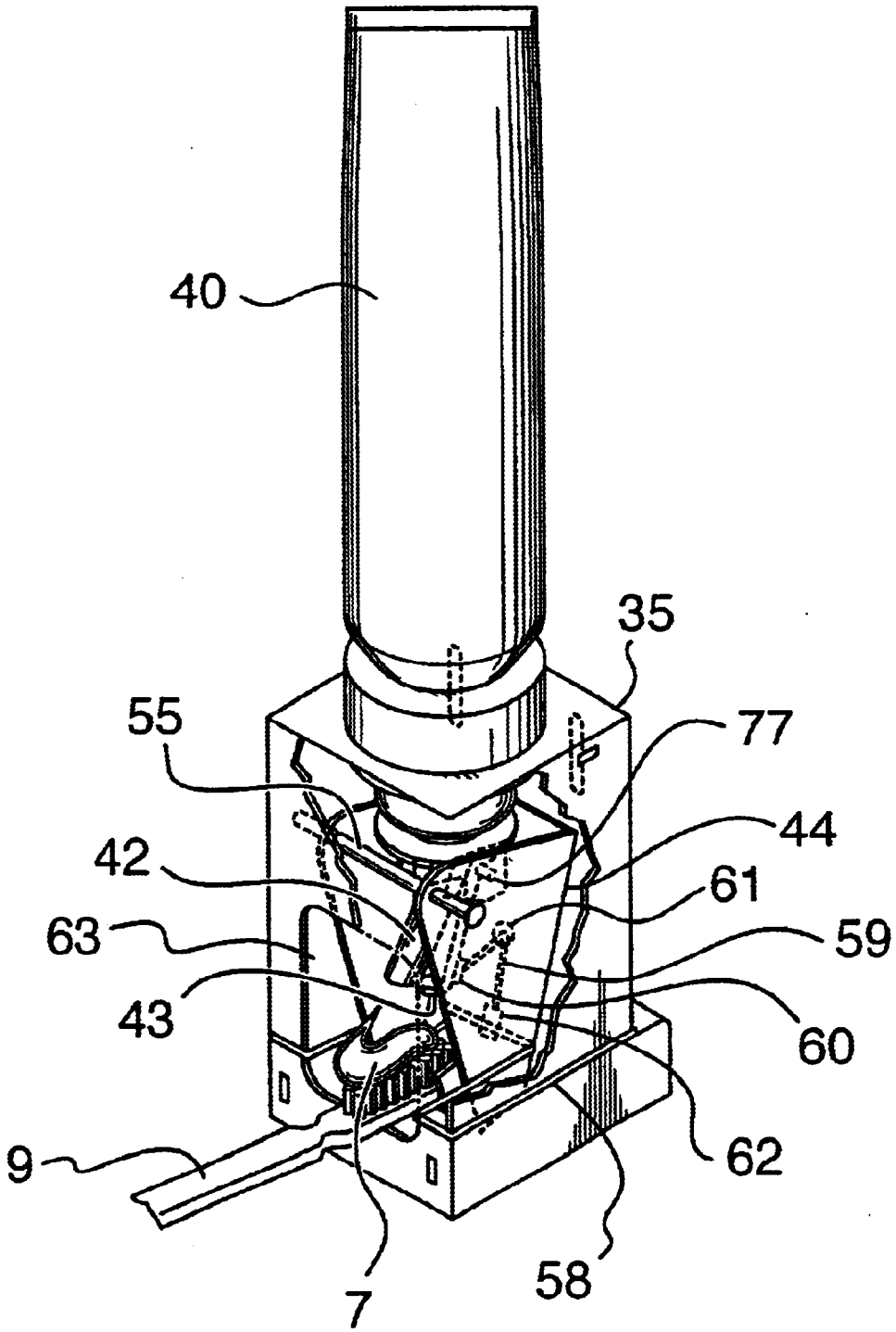
FIG. 11 is a perspective view of the housing, as shown in FIG. 10, with toothpaste being dispensed.

FIG. 11 shows the system at the peak of the dispensing stroke when the toothbrush 9 has pushed back the swing trigger 44 around the swing trigger axle 55, so that nubs 54 positioned on trigger 44 as shown push up against displacement ring 53 (FIG. 12) causing the displacement chamber 39 (FIG. 12) to distort and reduce its holding volume, the effect of which is enhanced by the inclusion within the chamber 39 of void-filling washers 51 and 52 (FIG. 12). In a preferred embodiment there are two upper washers 51 which are both relatively soft and compressible, and a single rigid or semi-rigid lower washer 52. These three washers perform the following functions:

(a) They greatly reduce the volume of the displacement chamber, making the evacuation of toothpaste (Accomplished through the holes in the washers) more efficient and the likelihood of air voids more remote.

(b) Washers 51 deform to suit each toothpaste tube as the geometry of air voids and toothpaste flow varies from tube to tube. The deformation of the washers tends to block the formation of air voids to such an extent that pumps equipped with the washers ought to be able to evacuate practically all the toothpaste in a tube, creating such a strong vacuum within the tube that the body of the tube collapses to an area within the bounds of the tube shoulder.

(c) Rigid washer 52 bears against a shoulder 75 (FIG. 12) along the upper periphery of the displacement chamber to prevent washers 51 from extruding into the displacement chamber and blocking the chamber's outlet.

The swing trigger 44 is held in a stand-by mode position as shown in FIG. 10 by a resilient member such as an elastic band 58 which stretches under pressure from the toothbrush 9 allowing the trigger 44 to swing to the rear of the dispenser. This elastic band 58 cooperates with another elastic band 59 which acts to swing the spout closer 43 clear of the spout 42, once the override deterrent of elastic 58 has been removed by the swinging back of trigger 44. The nubs 54 on trigger 44 are positioned such that they do not engage and lift displacement ring 53 until spout closer 43 has cleared the end of spout 42, so that toothpaste 7 does not begin to issue from spout 42 until such clearance occurs. With the upward movement of displacement ring 53 and the reduction of volume within chamber 39, a flap valve 38 closes, stopping regression of air and toothpaste into tube 40, and flap valve 41 opens allowing the evacuation of toothpaste 7 from the spout 42. Upon withdrawing the toothpaste-loaded toothbrush 9, pressure is removed from elastic 58 and it contracts to return trigger 44 to the stand-by mode, overriding elastic 59. Elastic 59 is kept in position by a retaining hook 60 on the spout closer 43 with elastic 59 being fed through a hole 61 in the rear of the trigger 44 and down to an elastic band retainer 62. Elastic 58 is kept in place by the elastic band retainer 62 and by threading elastic 58 through the front opening 63 of the housing 35 and round the outside of housing 35.

The present device differs from the art because it uses the collapsability of the toothpaste tube 40, and uses a closed system that creates a vacuum behind the toothpaste mass, and a partial vacuum ahead of that mass. Dispensing strokes cause the evacuation of toothpaste because of volume reduction within chamber 39, and refilling of the chamber 39 with toothpaste 7 from the tube 40 because of the pressure differential between the two as chamber 39 recovers to its original size and shape.

The vacuum created in chamber 39 as it recovers can be strong enough to cause the almost-empty tube 40 to bend over as it collapses and for chamber 39 to be held in the reduced volume mode. In most cases the advantage of being able to use the pliability of tube 40-disappears as the sides of the tube 40 begin to feel the effect of the strengthening dish at the base of the tube nozzle but by that time sufficient toothpaste has been evacuated from tube 40 to make the discarding of the tubi 40 economical.

Occasionally small air voids will occur despite preparing the tube but these voids can be cleared either by rapid pumping of swing trigger 44 or by the priming procedure outlined above. Otherwise the system when used with a squeeze-type collapsible toothpaste container acts entirely on conditions within the closed system and not according to outside influences as with all other known toothpaste pump systems.

FIG. 12 is a sectional view of the system in the stand-by mode and showing a slot 52 prepared to accept a toothbrush holder 51 such as prongs when the unit is fixed to a vertical surface. FIG. 12*a* shows the pump of FIG. 12 in the dispensing mode and shows flap valve 38 closed whilst flap valve 41 is open to evacuate toothpaste 7 onto the toothbrush 9. FIG. 12*b* shows valve 38 open and valve 41 closed just after completion of the dispensing stroke, with the reduced pressure in the displacement chamber 39 causing toothpaste to flow from tube 40 and making valve 411 close.

Figure 13:
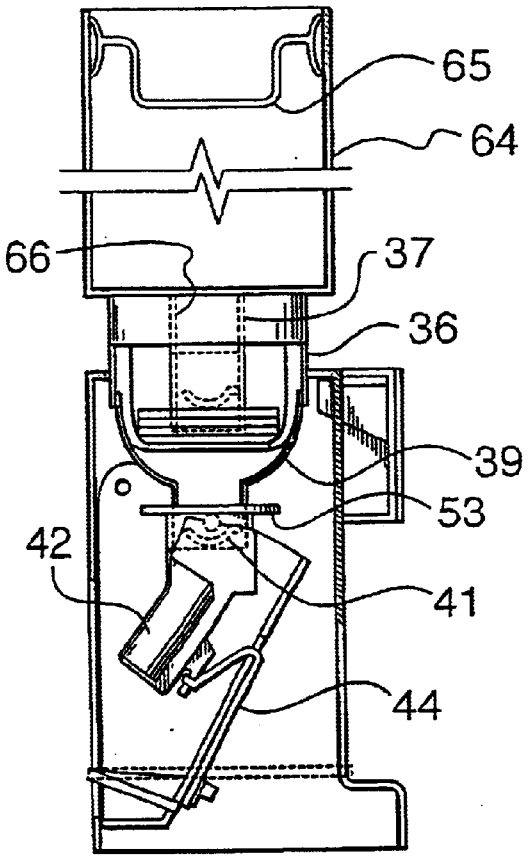
FIG. 13 is a sectional view of the housing, coupled with the inverted pump, in use with a replaceable cartridge of toothpaste.
Figure 13A:
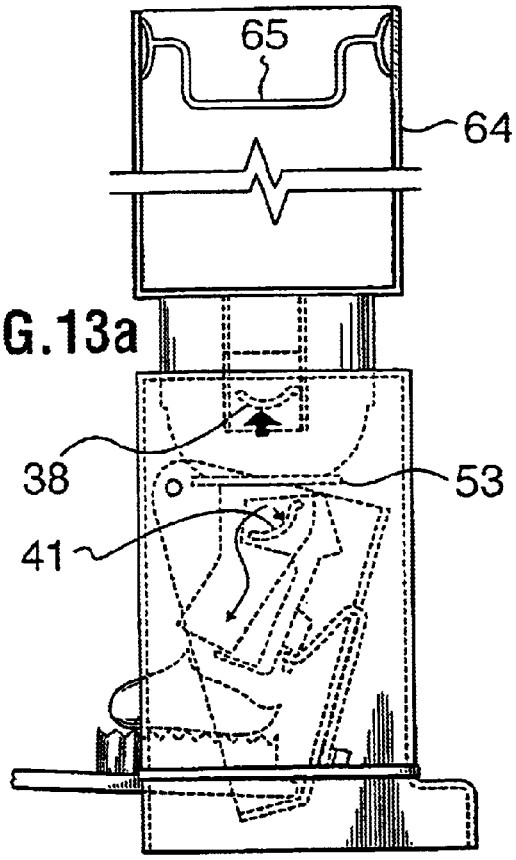
FIG. 13*a* is a sectional view, showing the positions of the valves within the pump, while toothpaste is being dispensed from the cartridge.
Figure 13B:
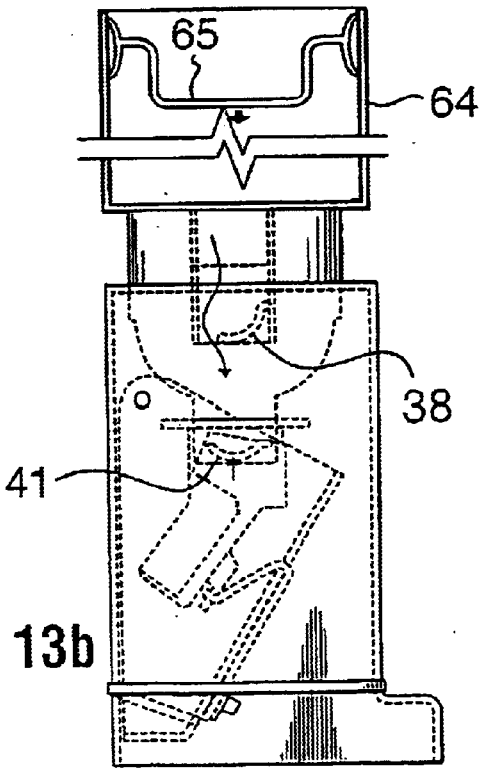
FIG. 13*b* is a sectional view, showing the positions of the valves within the pump, and the follower piston moving downwards within the cartridge, after toothpaste has been dispensed.

FIGS. 13 to 13*b* show pump 36 connected to a replaceable cartridge 64 of toothpaste instead of a squeeze tube 40. The volume reduction operation for displacement chamber 39 remains the same as when a tube 40 is used with the unit. However, replacement cartridge 64 utilizes a follower piston 65 that moves downwards when atmospheric pressure is greater than the pressure within replaceable cartridge 64. Cartridge 64 attaches to pump 36 with a threaded nozzle 66 (see also FIG. 14) which meets with a tube connector 37 of pump 36. The pump is primed by pushing down, on follower piston 65 until toothpaste appears at pump spout 42, after which normal dispensing of toothpaste will occur upon dispensing strokes of swing trigger 44, with follower piston 65 moving downwards incrementally with each dispensing stroke.

FIG. 13*a* shows the valve positions at the peak of the dispensing stroke with valve 38 closed and valve 41 open due to the increase in pressure in chamber 39 as it is squeezed by ring 53. FIG. 13*b* shows the valve positions at the end of the dispensing stroke when the toothbrush is removed and chamber 39 expands back to its original size and shape. When this occurs, the resulting vacuum in the chamber causes valve 38 to open allowing toothpaste 7 to move from container 64 into chamber 39 and follower piston 65 to move downwardly until pressure within chamber 39 and container 64 equalizes, or chamber 39 becomes full. The reduced pressure in chamber 39 during this time has kept valve 41 closed and so it remains until the next dispensing stroke.

Figure 14:
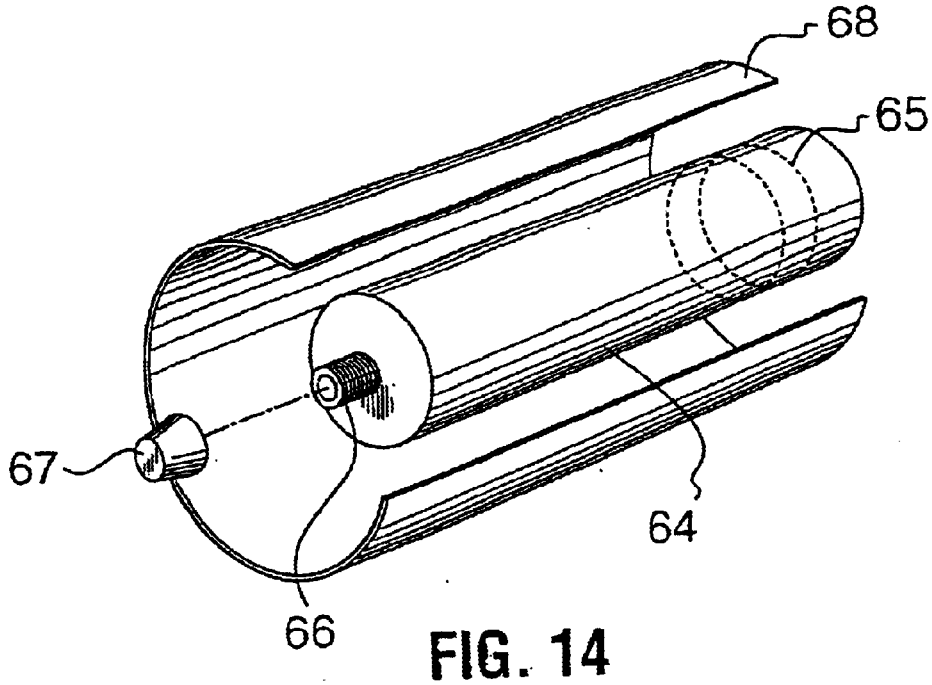
FIG. 14 is a perspective view of the replaceable cartridge.

FIG. 14 is a perspective view of pack 64 with seal cap 67, follower piston 65, screw nozzle 66 (to fit tube connector 37) and printed shrink wrap 68.

Figure 15:
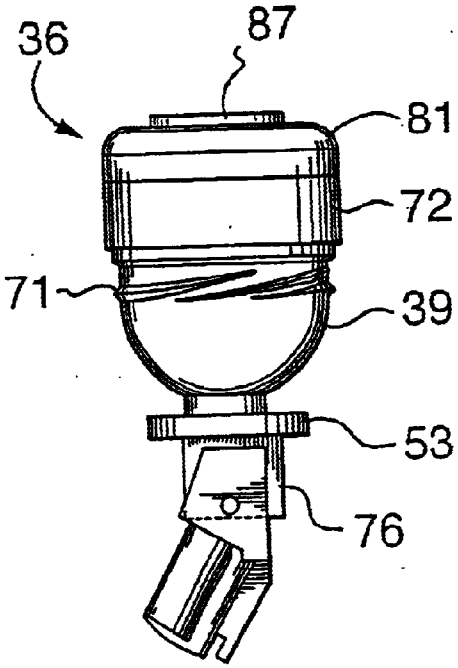
FIG. 15 is a side elevational view of the pump assembly.
Figure 15A:
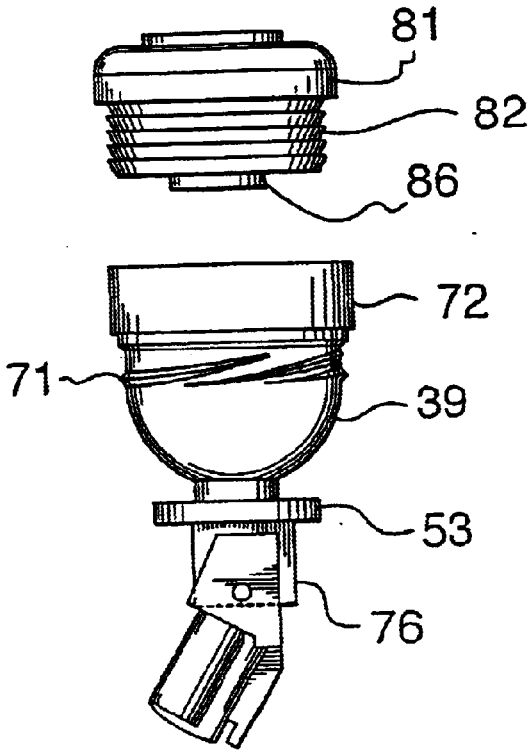
FIG. 15*a* is a partially exploded side elevational view of the pump assembly.

A more detailed description of the individual components of the pump now follows with reference to FIGS. 15 to 21*a*. FIG. 15 shows an assembled pump 36 with all of its components. These include a connecting adaptor 81, a seating component 72, a flexible chamber 39, and a spout assembly 76. FIG. 15*a* shows a partially exploded view of pump assembly 36, in which adaptor 81 is shown detached from the remainder of pump assembly 36. Each of these components will be described in more detail below.

Figure 16:
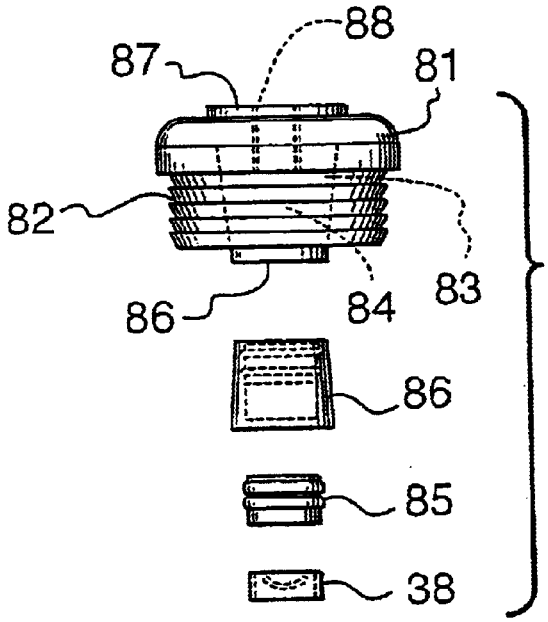
FIG. 16 is an exploded sectional view of the connecting device of the pump assembly.

FIG. 16 is an exploded view of adaptor 81. Adaptor 81 is used to connect a toothpaste dispenser to the remainder of the pump. To accomplish this, adaptor 81 is provided with a threaded cylindrical bore 88 in its upper surface 87. This threaded cylindrical bore is adaptable to accommodate various diameters of nozzles on toothpaste dispensing tubes, packs or other reservoirs.

Threaded cylindrical bore 88 connects to an internal chamber 83. Internal chamber 83 comprises a frustoconical inner bore to accommodate a valve system 84.

Valve system 84 comprises a frustoconical insert 86, nozzle 85 and flap valve 38. Insert 86 is adapted to fit concisely within internal chamber 83. Insert 86 further has an inner bore configured to accommodate nozzle 85 and flap valve 38.

Flap valve 38 is a one-way valve that only allows flow of toothpaste out of nozzle 85. Valve system 84 therefore only allows toothpaste to flow out of adaptor 81 as described below.

In operation, a toothpaste tube or pack is connected to cylindrical bore 88 and toothpaste is allowed to flow through nozzle 85 and flap valve 38, but is prevented from flowing back into the toothpaste tube by flap valve 38.

Adaptor 81 is further provided with external threading 82. External threading 82 is adapted to allow adaptor 81 to be affixed to the remainder of pump 36.

Figure 22:
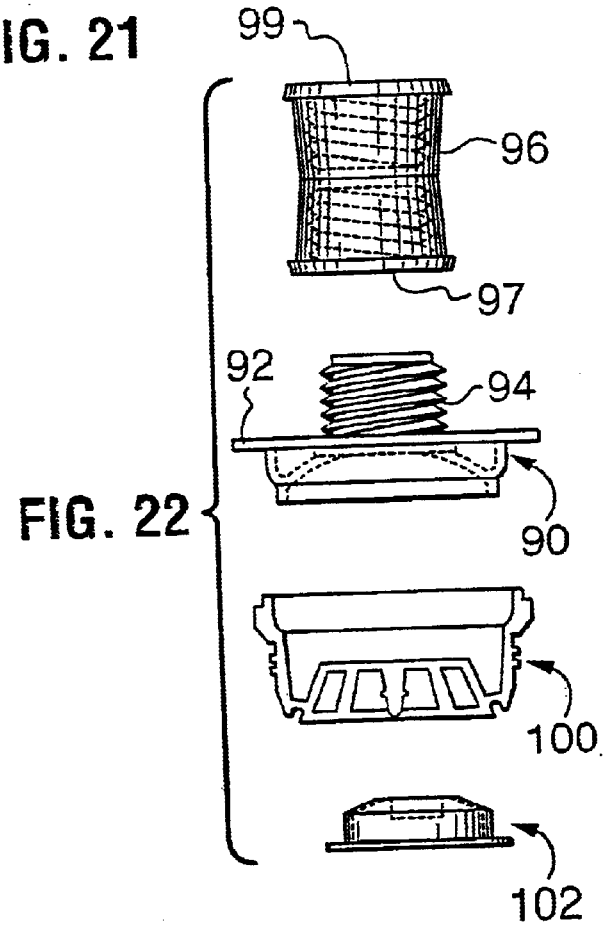
FIG. 22 is an exploded side elevational view of an alternative embodiment of the connecting device of the pump assembly.

An alternative embodiment of an adaptor 90 is illustrated in FIG. 22. Adaptor 90 includes a radially extending flange 92 that rests against the upper surface of housing 35 for connection to the housing by means of adhesive, for example, or the housing can be formed integrally with the adaptor. The adaptor includes an upwardly extending externally threaded sleeve 94 adapted for a threaded connection to a cylindrical sleeve 96 internally threaded at each of its ends 97 and 99. End 97 connects to sleeve 94 and end 99 can connect directly to the threaded nozzle of a tube or pack of toothpaste. Various manufacturers use different sized nozzles for their toothpaste containers. A user can therefore choose a sleeve 96 which corresponds with the brand of toothpaste container being used.

Connector 90 further includes a lower cylindrical portion 98 which is adapted to connect concentrically into a flow valve housing 100. Flow valve housing 100 in turn concentrically connects to flow valve 102 at its lower end. The outer surface 101 of flow valve housing 100 is adapted for connection to flexible chamber 39, as described in more detail below.

Flow valve 102 only allows toothpaste to flow in one direction, similar to flap valve 38. Further, flow valve 102 provides better sealing against air leaks than flap valve 38, and thus provides a more efficient pump.

Figure 17:
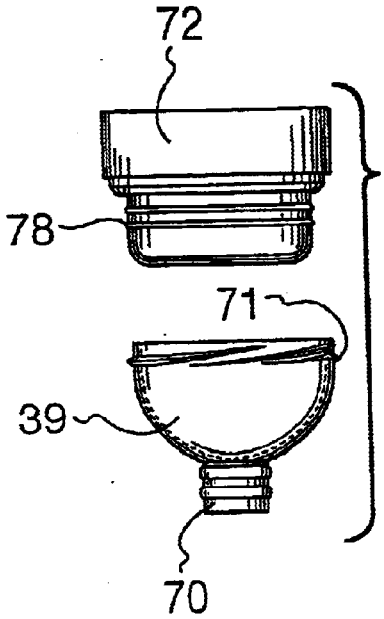
FIG. 17 is an exploded side elevational view of the displacement chamber portion of the pump assembly.
Figure 17A:
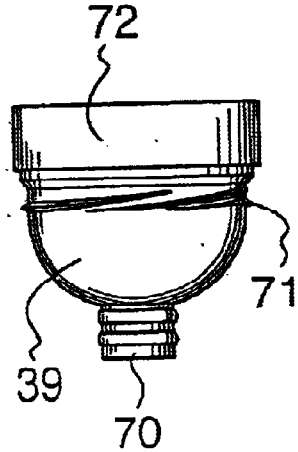
FIG. 17*a* is a side elevational view of the displacement chamber portion of the pump assembly.

Reference is now made to FIGS. 17 and 17*a*. FIG. 17*a* shows a preferred embodiment of seating component 72, flexible chamber 39, and threaded nozzle 70. FIG. 17 shows an exploded view thereof. These components fit below adaptor 81 and form the next part of the flow path for pump 36.

Seating component 72 is a hollow rigid cylindrical tube and is internally threaded for connection to threading 82 on adaptor 81.

As can be seen in FIG. 17, a ridged flange 78 extends downwardly from seating device 72. This ridged flange is also hollow and is adapted to seal into flexible chamber 39 for a fluid tight connection between the chamber and seating component 72.

Flexible chamber 39 is best seen in FIG. 17. The chamber is a resiliently flexible bladder which can be deformed in operation. The upper edge of the chamber 39 is configured to be sealingly connected to flange 78 as described above. The lower end of chamber 39 discharges through attached rigid nozzle 70. The chamber's outer surface is threaded at 71 where it is reinforced by flange 78 for connection to the pump housing.

In the alternative embodiment of FIG. 22, flexible chamber 39 is connected to flow valve housing 100. In both embodiments, the flexible chamber operates in a similar manner.

Rigid nozzle 70 is externally threaded for connection to displacement ring 53.

Figure 18:
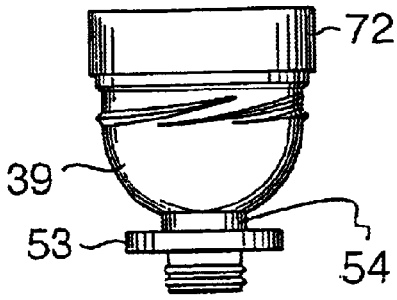
FIG. 18 is a side elevational view of the displacement chamber portion of the pump assembly with a displacement cylinder affixed to it.
Figure 18A:
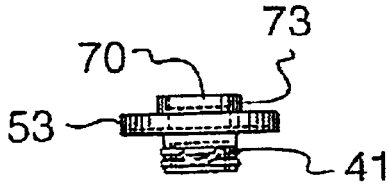
FIG. 18*a* is a sectional view of the displacement cylinder.
Figure 18B:
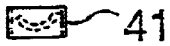
FIG. 18*b* is a sectional view of a flap valve.

Reference is now made to FIGS. 18 to 18*b*. These figures show displacement ring 53 as attached to flexible chamber 39.

Displacement ring 53 incorporates a rigid hollow cylindrical tube 54. The internal upper end of tube 54 is internally threaded for connection to discharge nozzle 70. The lower end of tube 54 is adapted to internally accommodate flap valve 41. Externally, the lower end of tube 54 is threaded for connection to spout assembly 76.

Flap valve 41 allows toothpaste to flow through tube 54 into spout assembly 76, but does not allow toothpaste to flow in the reverse direction.

Displacement ring 53 is disposed around tube 54. Displacement ring 53 is a rigid cylindrical flange that extends radially outwardly from the tube and is used to distort flexible chamber 39, as described both above and below.

Figure 19:
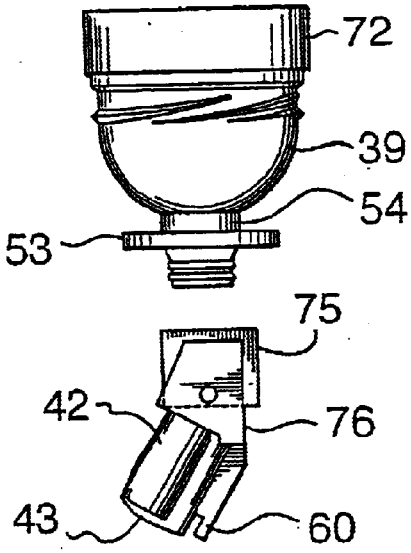
FIG. 19 is an exploded side elevational view of the displacement chamber portion of the pump assembly with a nozzle assembly.
Figure 19A:
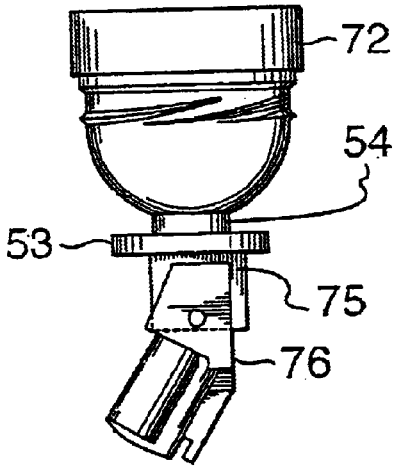
FIG. 19*a* is a side elevational view of the displacement chamber portion of the pump assembly with a nozzle assembly.
Figure 20:
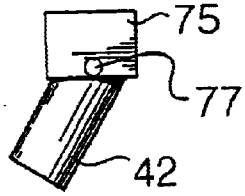
FIG. 20 is a side elevational view of the spout portion of the nozzle assembly.
Figure 20A:
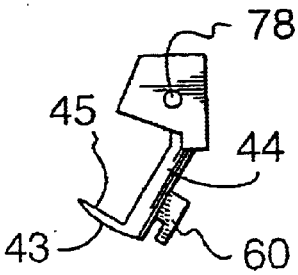
FIG. 20*a* is a side elevational view of the closure portion of the nozzle assembly.
Figure 20B:
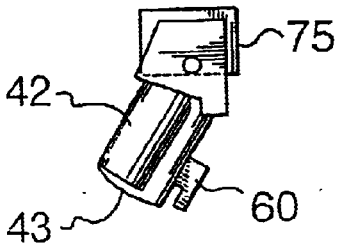
FIG. 20*b* is a side elevational view of the nozzle assembly in isolation.

Pump 36 is further provided with spout assembly 76 shown most clearly in FIGS. 19 to 20*b*. FIGS. 19 and 19*a* show an assembled spout assembly 76, where the spout assembly is connected to nozzle 70 in FIG. 19*a*, and is separated from the nozzle assembly in FIG. 19. FIG. 20*b* shows the nozzle assembly in isolation. FIGS. 20 and 20*a* show the individual components of nozzle assembly 76.

Nozzle assembly 76 includes a connector 75 which is a hollow cylinder whose upper end is internally threaded for a threaded connection to the lower end of tube 54. The lower end of connector 75 connects to spout 42.

Spout 42 extends downwardly and forwardly from connector 75 at an angle suitable to allow a user to obtain toothpaste when inserting a toothbrush into the pump housing against trigger 44.

Connector 75 has two nubs or pins 77 protruding outwardly from opposite sides of connector 75. The nubs extend perpendicularly from the direction of extension of spout 42. Nubs 77 pivotably support spout closing mechanism 43. Closing mechanism 43 is formed with two complementary holes 78 into which nubs 77 fit for a rotatable connection of closing mechanism 43 to connector 75. Closing mechanism 43 is provided with a downwardly extending arm 44 and a forwardly extending flange 45. These are shaped to fit over spout 42 and to normally close spout 42 and protect its contents from the environment when toothpaste is not being dispensed. Closing mechanism 43 is additionally formed with a retaining hook 60. Retaining hook 60 is elastically connected to the pump housing as described above, to normally bias flange 45 into its spout sealing position as shown most clearly in FIGS. 19*a* and 20*b* when the pump is not in use.

Figure 21:
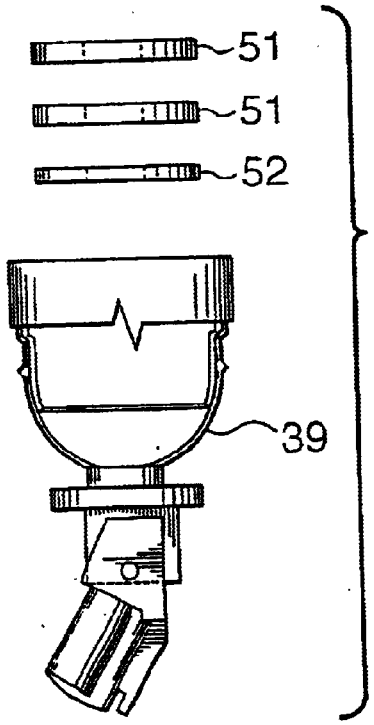
FIG. 21 is a partially exploded view of the pump assembly with washers shown separately from the remainder of the pump assembly.
Figure 21A:
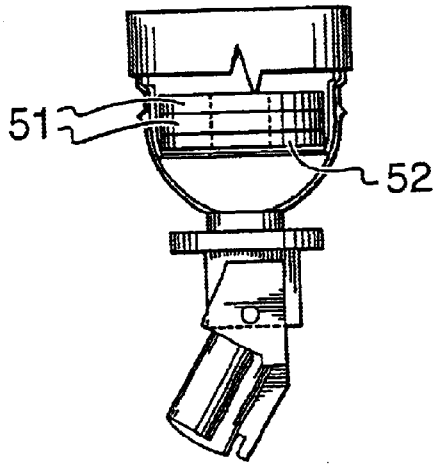
FIG. 21*a* is a sectional view of the pump assembly showing the placement of the washers within the pump assembly.

Pump 36 is further provided with ring washers 51 and 52 as best seen in FIGS. 21 and 21*a*. These ring washers fit between adaptor 81 and flexible chamber 39, providing a better seal for flexible chamber 39 and to reduce the volume in chamber 39 available for toothpaste.

Washers 51 are semi-rigid and compressible. The semi-rigid nature of the washers allows them to provide a better seal between adaptor 81 and flexible chamber 39. In a preferred embodiment, washers 51 are comprised of foam, and two such washers are provided in pump 36.

Washer 52 is preferably made of a rigid plastic to ensure that washers 51 do not collapse into flexible chamber 39.

In operation, a user affixes a toothpaste source to adaptor 81 or adaptor 96. Once the system is primed, pump 36 then allows toothpaste to be extracted without the need for the user to squeeze the toothpaste source. This works in the manner described above.

Once the toothpaste has been discharged onto the toothbrush, the user removes the toothbrush. The resilient nature of flexible chamber 39 causes it to expand back to its original shape and volume. This expansion increases the volume of the chamber, causing a vacuum. Flap valve 41 below the chamber prevents any toothpaste that is in spout 42 from reentering the chamber, and thus the chamber is refilled with toothpaste flowing through flap valve 38 or flow valve 102 above the chamber due to the pressure differential between the vacuum in chamber 39 and atmospheric pressure acting on the toothpaste tube or follower piston 65.

Figure 23:
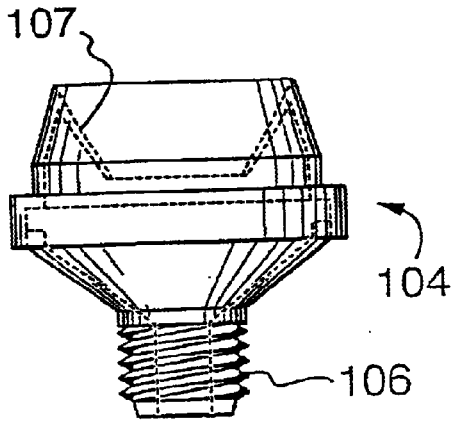
FIG. 23 is a side elevational view of a cleaning apparatus for the present invention.

In order to clean the pump, the present invention is further provided with a cleaning attachment 104 as shown in FIG. 23. Cleaning attachment 104 is provided with a threaded cylindrical neck 106 which can be screwed into bore 88 or sleeve 96. The upper end 107 of cleaning attachment 104 is adapted for connection to a water faucet. In operation, the user connects attachment 104 to the pump assembly and to a faucet. The user then opens spout 42 and turns on the faucet, allowing water to flow through the pump assembly, thereby cleaning it.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

What is claimed is:

1. A dispenser for a viscous substance, comprising:

a housing;

a reservoir for said viscous substance;

pump means actuatable to discharge said substance from said reservoir; and lever means pivotally connected to said housing actuatable between a first at rest position; and a second pump actuating position, wherein pressing on said lever means using a receptacle intended to receive said viscous substance thereon moves said lever means from said first to said second positions thereof to actuate said pump means and cause a discharge of said viscous substance, said pump means including a deformable bladder, said deformable bladder having sufficient elastic memory to return to its original configuration when no external pressure is applied thereto, an upper one way valve, said upper one way valve configured to allow flow of the viscous substance into said deformable bladder only, a lower one way valve, said lower one way valve configured to allow flow of the viscous substance out of said deformable bladder only, and deforming means operatively associated with said lever means and being disposed to deform said bladder as said lever means are moved into said puma actuating position thereof, which reduces the volume of said bladder, causing said viscous substance therein to discharge out of said lower one way valve, and whereby said lever means moving into said at rest position thereof allows said bladder to return to its said original configuration, which increases its internal volume, said increase in volume drawing the viscous substance into said bladder through said upper one way valve.

2. The dispenser of claim 5, wherein dispensing of the viscous substance can be accomplished by a user holding said toothbrush using only one hand.

3. The dispenser of claim 5, further comprising an adapter attachable to said lever means, whereby said adapter allows toothbrushes of different sizes and shapes to be used by adjusting the position of the toothbrush relative to said lever means.

4. The dispenser of claim 1, wherein the viscous substance is toothpaste.

5. The dispenser of claim 4, wherein said receptacle is a toothbrush.

6. The dispenser of claim 1, wherein said housing includes at least one detachable container, said detachable container being adapted to hold a toothbrush.

7. The dispensir of claim 6, wherein said detachable container is adapted to hold only a single toothbrush.

8. The dispenser of claim 1 wherein said lever means is normally biased into said first position thereof.

9. The dispenser of claim 8 further including a resilient member for normally biased said lever means into said first at rest position thereof.

10. The dispenser of claim 9 wherein said resilient means is an elastic band disposed between said lever means and said housing for normally biased said lever means into said first at rest position thereof.

* * * * *